US007089833B2

(12) United States Patent
Hamann et al.

(10) Patent No.: US 7,089,833 B2
(45) Date of Patent: Aug. 15, 2006

(54) AIR ACTUATED PNEUMATIC IMPACT WRENCH LUG BOLT TOOL

(75) Inventors: James E. Hamann, Palos Park, IL (US); George R. Hamann, Lemont, IL (US)

(73) Assignee: H.B. Products, Inc., Chicago, IL (US)

( * ) Notice: Subject to any disclaimer, the term of this patent is extended or adjusted under 35 U.S.C. 154(b) by 0 days.

(21) Appl. No.: 10/739,367

(22) Filed: Dec. 18, 2003

(65) Prior Publication Data

US 2005/0132850 A1 Jun. 23, 2005

(51) Int. Cl.
*B25B 19/00* (2006.01)
*B25B 21/00* (2006.01)
*B25B 23/14* (2006.01)

(52) U.S. Cl. ..... 81/465; 81/463; 81/464; 81/466; 81/467; 81/180.1

(58) Field of Classification Search ..... 81/463–467, 81/180.1

See application file for complete search history.

(56) References Cited

U.S. PATENT DOCUMENTS

| | | | | | |
|---|---|---|---|---|---|
| 1,923,122 | A * | 8/1933 | Smith | 173/93 |
| 2,600,796 | A * | 6/1952 | Nash | 81/463 |
| 3,158,050 | A * | 11/1964 | Shandel | 173/93 |
| 3,831,468 | A * | 8/1974 | Miller | 81/466 |
| 3,832,917 | A * | 9/1974 | Feith | 81/462 |
| 3,949,816 | A * | 4/1976 | Harvath | 173/93 |
| 4,300,412 | A * | 11/1981 | Houser et al. | 81/462 |
| 4,346,630 | A | 8/1982 | Hanson | |
| 4,688,454 | A | 8/1987 | Scull | |
| 4,864,902 | A * | 9/1989 | Doorley | 81/466 |
| 4,960,014 | A | 10/1990 | Kelly | |
| 4,993,288 | A | 2/1991 | Anderson | |
| 6,308,596 | B1 | 10/2001 | Williams | |
| 6,354,178 | B1 * | 3/2002 | Pool et al. | 81/463 |
| 6,748,832 | B1 * | 6/2004 | Maxwell | 81/462 |
| 6,748,833 | B1 * | 6/2004 | Williams | 81/465 |
| 6,769,334 | B1 * | 8/2004 | Whitehead et al. | 81/463 |
| 2005/0000329 | A1 * | 1/2005 | Pregeant | 81/466 |

OTHER PUBLICATIONS

Powerbar Hand Impact Wrench designed by MAC Tools, Inc., as seen in attached advertisement.

* cited by examiner

*Primary Examiner*—David B. Thomas
*Assistant Examiner*—Bryan R. Muller

(57) ABSTRACT

The invention relates to a device utilizing compressed air for loosening and tightening fasteners that are located in hard to access areas. The device enables a single operator to stabilize the device while applying pressure via a pneumatic hammer to loosen or tighten fasteners. The device uses socket principles that enable the user to switch the sockets and provide a wide variety of options to accommodate the shapes and sizes of the fasteners.

2 Claims, 2 Drawing Sheets

AIR ACTUATED PNEUMATIC IMPACT WRENCH LUG BOLT TOOL

BACKGROUND OF THE INVENTION

The variety in the available types of ratchets and wrenches has increased over the years. The need for advancement in the development of quality engineered wrenches and ratchets and a corresponding need to maneuver these tools in small places has long been desired. Ratchet wrenches which are hand held and driven by a motor are known in the art. The present invention is not limited by a drive motor and thus is a more reliable and durable tool. Examples of prior art devices with drive motors are illustrated in U.S. Pat. Nos. 4,346,630 and 4,993,288.

U.S. Pat. No. 4,346,630, issued to Hanson is considered a pneumatic or power wrench. This patent embodies a ratchet wrench having a drive motor and a member which drives a shaft configured to carry a socket to fit to a nut to be turned. To provide the necessary torque to turn a nut, this patent utilizes a drive motor which is preferably an air motor.

U.S. Pat. No. 4,993,288 issued to Anderson et al. relates to a ratchet adapted for a power drive. Although, this invention may be compact and provide considerable torque, its rotation is also driven by drive motor.

In addition to wrenches and ratchets with drive motors, the prior art also includes manual tools and extensions that have limitations overcome by the present invention. U.S. Pat. No. 4,688,454 issued to Scull claims to be an open-ended, high torque wrench for use on nuts to which there is limited access. This patent includes a seven point single jaw open-ended wrench containing a double square socket positioned at 90 degrees from the jaw opening. To function or rotate, this wrench would be attached to a click-type wrench handle which includes a square protrusion to be engaged in the double square socket.

Devices in the prior art that act as an extension are illustrated by U.S. Pat. Nos. 4,960,014 and 6,308,596. These patents issued to Kelley and Williams, respectively, relate to hand wrench torque enhancing devices. To increase the amount of torque provided by a given wrench, these devices provide an extension handle essentially to increase the length of the wrench thereby increasing the mechanical advantage, i.e. torque, of the wrench. However, this product is still nonetheless man powered as it is still necessary for a person to provide the actual "force" required to use the wrench (apply the torque). Furthermore, as a consequence of a longer handle, it would also be difficult to operate wrenches with these extensions in limited areas. The longer handle increases the degree of rotation applied by the user necessary to turn the wrench. In an area where there is no significant space around the object of which the wrench will be applied, these extension devices will be prohibited from being used as the necessary degree of rotation will be obstructed.

Another device in the market is the Power Bar Hand Impact Wrench by MAC Tools. This device utilizes a manual hammer to apply torque to fasteners but is limited in certain aspects that the present invention overcomes. The hammer only yields about two to three degrees of rotation per swing where the present invention is capable of more. Also, the Powerbar Hand Impact Wrench has rubber material that requires maintenance or replacement and under certain working conditions does not perform as well as the present invention.

BRIEF SUMMARY OF THE INVENTION

These and other problems and disadvantages associated with the prior art are overcome by one form of the invention disclosed herein by providing, a durable and reliable device utilizing compressed air to enable a user to loosen or tighten fasteners that are located in areas that would otherwise be difficult to access.

The device has several elements that enable a user to create a torque force to either tighten or loosen fasteners. There is a stabilizing fixture that has a U-shaped head extending from one end of a rod. The other end of the rod enables a user to use his free hand for support while applying a pneumatic force to the device. This is important because when torque is exerted on the fastener, it tends to disengage the socket. The rod acts as a reaction bar which creates a counter torque, thereby keeping the socket engaged on the fastener. The U-shaped head has an adapter on one side to accommodate various sizes of sockets. There is a lever that is rotatably associated with and extending from the U-shaped head. The relationship between the lever and the U-shaped head is such that the lever is rotatably driven at one end and constrained to move in an arcuate path dictated by the U-shaped head.

The lever and socket are rotatable about the same axis. The lever also has a solid cylinder that is fixedly attached that permits removeable attachment between a transfer fixture and the lever. The distance between the centerline of the socket and the centerline of the solid cylinder creates the torque. The transfer fixture is removeably associated with a pneumatic hammer that provides the force to rotate the lever in the desired direction to loosen or tighten fasteners. The transfer fixture has a four pronged head that is removeably associated with the solid cylinder. The opposite end of the transfer fixture has a standard pneumatic hammer shank to permit the transfer of force from a pneumatic hammer to the device.

Further objects and advantages of the invention will become apparent from the following description taken in conjunction with the accompanying drawings.

BRIEF DESCRIPTION OF THE DRAWINGS

In order to satisfy the loosening or tightening fasteners that are located in hard to access areas is provided as illustrated by the accompanying drawings wherein.

DESCRIPTION OF THE PREFERRED EMBODIMENT

Figure 1:
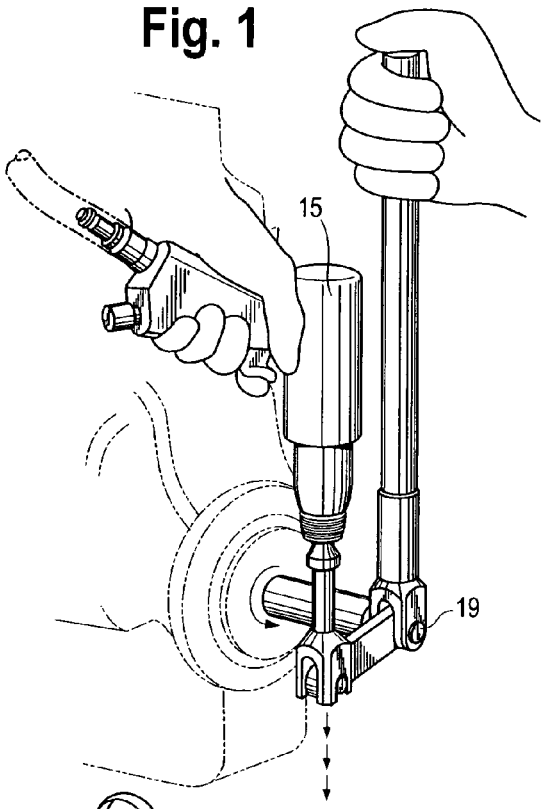
FIG. 1 is a pictorial view of the device and a pneumatic hammer illustrating the relation of the system with a single operator and the direction of the forces applied along with the revolution (loosening) of the socket.
Figure 2:
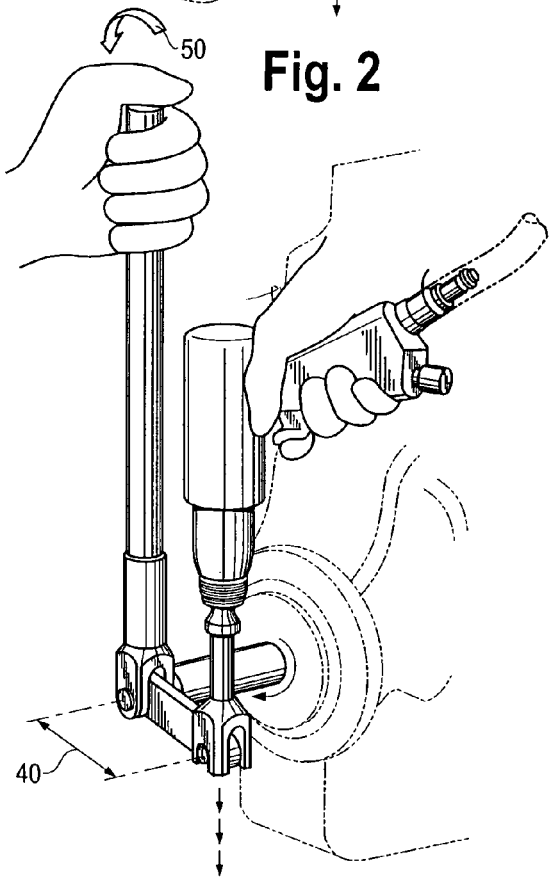
FIG. 2 is another pictorial view of the device and a pneumatic hammer illustrating the relation of the system with a single operator and the direction of the forces applied along with the revolution (tightening) of the socket in the direction opposite FIG. 1.

Referring to FIG. 1, the present invention is combined with a pneumatic hammer 15 that supplies a downward force to the device. The pneumatic hammer 15 is connected to any source providing air pressure, typically in a garage or from a compressor. The pneumatic hammer 15 is removeably attached to the transfer fixture 13 via a standard pneumatic hammer shank 12 creating a snug fit. This fit enables the pneumatic hammer 15 to apply a downward force using air pressure that is transferred to the device via the transfer fixture 13 and eventually to the socket 9 enabling a user to loosen or tighten fasteners.

Figure 3:
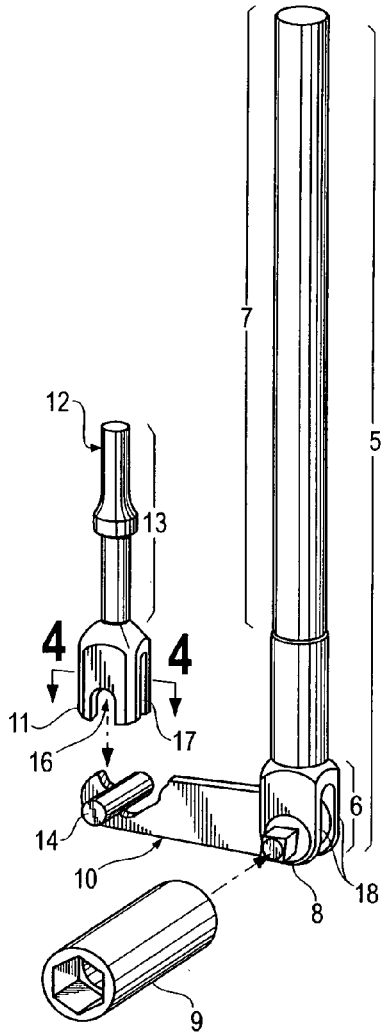
FIG. 3 is an exploded view of the device illustrating the removable transfer fixture and socket, along with a partial cutaway view of the relationship between the solid cylinder and the lever.
Figure 4:
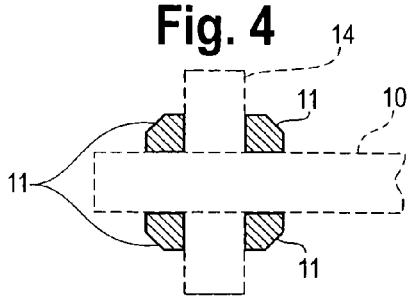
FIG. 4 is a cross sectional top view of the relationship between the solid cylinder, the transfer fixture, and the lever.
Figure 5:
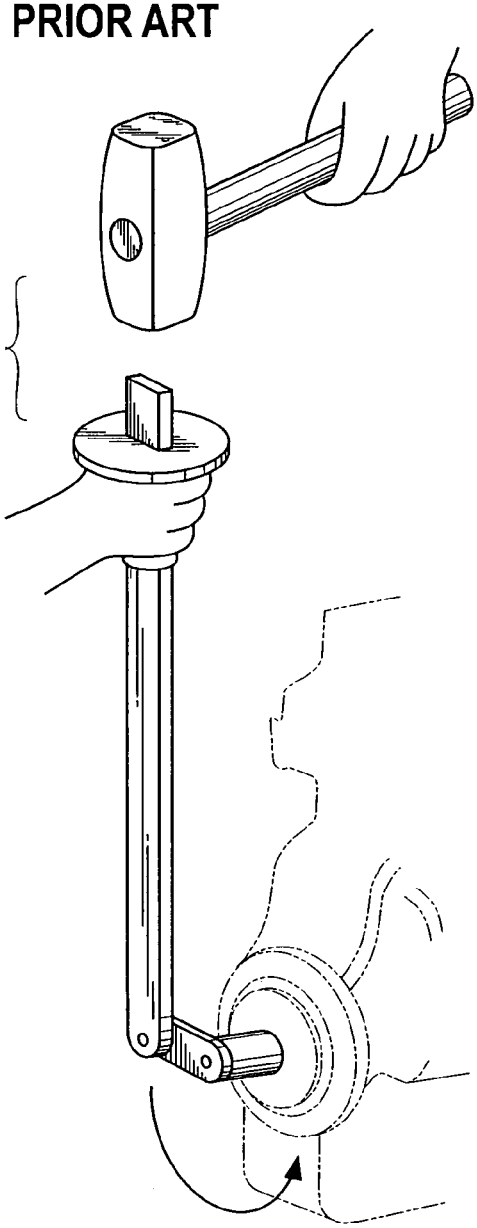
Fig. 5 PRIOR ART
FIG. 5 is a pictorial view of a prior art device illustrating the relation of the system with an operator and a hammer and the torque force applied along with the revolution of the socket.
Figure 6:
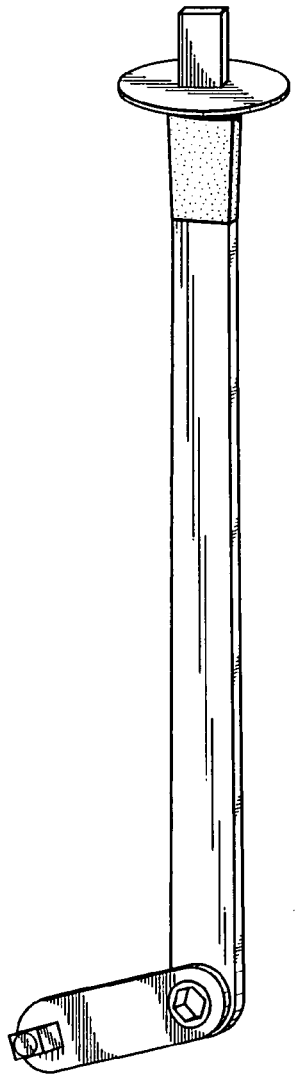
Fig. 6 PRIOR ART
FIG. 6 is a pictorial view of the same prior art device in FIG. 5 without the torque force shown in FIG. 5.

As seen in FIGS. 3 and 4, the transfer fixture 13 is removeably associated with the lever 10. This association is enabled by the fit between the four pronged head 11 of the transfer fixture 13 and the solid cylinder 14 fixedly attached to the lever 10. The four pronged head 11 has a cutout on each face, the opposite faces' cutouts mirroring the shape of one another. One pair is a horseshoe shaped cutout 16, the other is a rectangle shaped cutout 17. The horseshoe shaped cutout 16 is dimensioned relative to the solid cylinder 14 and the rectangle shaped cutout 17 is dimensioned relative to the lever 10. These dimensional relationships enable the transfer fixture 13 and the lever 10 to removeably fit in a manner that allows the transfer fixture 13 to have a small amount of rotation defined by the contact with the lever 10. This is useful for the user because they are not constrained with the pneumatic hammer 15 to one angle relative to the lever 10.

Lever 10 is rotatably attached at the end opposite solid cylinder 14 to the U-shaped head 6. Lever 10 is positioned between two prongs 18 of the U-shaped head 6. Lever 10 and adapter 8 are fixedly associated with one another through prongs 18 and are attached to the U-shaped 6 by a restraining ring 19 in a manner that enables them to synchronously rotate when the pneumatic hammer 15 exerts force through transfer fixture 13 on the solid cylinder 14. This relationship is a key element to the device because the force exerted on the transfer fixture 13 moves the lever 10 in an arcuate path synchronous to the adapter 8 to rotate the socket 9, thus loosening or tightening fasteners. Sockets of variable sizes and shape can be used provided the adapter 8 has industry standard shape on one side of adapter 8.

An additional element of the device is rod 7 that is part of the stabilizing fixture 5. The stabilizing fixture 5 does not rotate on the same axis that both lever 10 and adapter 8 rotate about. Rod 7 enables the user to use their free hand to support and counter balance the force being applied to the transfer fixture 13 that is rotating the lever 10 and the adapter 8. This, along with the mass and moment of inertia of rod 7, provides stability and safety for the user.

From the foregoing detailed description of the invention, it has been shown how the objects of the present invention have been obtained in a preferred manner. However, inferior embodiments, modifications, and equivalents of the disclosed concepts such as readily occur to those skilled in the art are intended to be included within the scope of the invention.

We claim:

1. A device utilizing compressed air for loosening or tightening fasteners that are located in hard to access areas comprising:

a stabilizing fixture having a U-shaped head with two prongs extending from one end of a rod, a lever rotatably associated with said U-shaped head, said lever residing between said two prongs and extending from said U-shaped head, an adapter associated to a the lever through said two prongs whereby said lever is rotatably driven at one end to cause synchronous rotation of said adapter relative to said U-shaped head;

a restraining ring member residing on a portion of said adapter that has passed through first U-shaped head prong, the lever, and second U-shaped prong, said adaptor being constrained to rotate by said U-shaped head, said adaptor being able to accommodate sockets of variable sizes and shapes, said lever and said adaptor achieving a synchronous motion with said socket to transmit torque to said socket, a transfer fixture having a four pronged head that is removeably associated with a pneumatic hammer forcing said lever to rotate in an arcuate path of motion to enable said socket to loosen or tighten said fasteners, said lever having a solid cylinder to permit removable attachment between the transfer fixture and the lever, whereby said four pronged removeably attached fixture and a pneumatic hammer shank enable transfer of force to said lever, and said stabilizing fixture having said rod remotely located from said socket whereby an operator can use his free hand for support for the purpose of loosening or tightening fasteners.

2. A process for loosening or tightening fasteners that are located in hard to access areas by employing a device using compressed air possessing a stabilizing fixture having a U-shaped head extending from one end of a rod, said U-shaped head having two prongs, rotatably associating a lever with said U-shaped head, the lever residing between said two prongs and extending from said U-shaped head, associating an adapter with said lever through said two prongs whereby said lever is rotatably driven at one end and results in synchronous rotation of said adapter relative to said U-shaped head;

associating a restraining ring member with a portion of said adapter that has passed through the first U-shaped head prong, said lever, and second U-shaped prong, constraining said adapter to rotate by said U-shaped head, providing said adaptor with shape able to accommodate sockets of variable shapes and sizes, thereby obtaining a synchronous motion with said lever and said adaptor to transmit force to said socket, providing a transfer fixture with a four pronged head that is removeably associated with a pneumatic hammer, forcing said lever to rotate in an arcuate path of motion to enable said socket to loosen or tighten fasteners, and said four pronged head being rigid with said transfer fixture and having a standard pneumatic hammer shank to enable transfer of force to said hammer shank, said stabilizing fixture having a rod remotely located from said socket enabling an operator to use his free hand for support for the purpose of loosening or tightening fasteners by an operator, comprising steps of:

placing said variably sized socket onto said adapter, placing said variably sized socket onto said fastener which needs to be loosened or tightened, placing said lever in a position that, when said pneumatic hammer forces said lever to rotate in an arcuate path, said fastener will be loosened or tightened, placing said pneumatic hammer with said transfer fixture removeably associated on said solid cylinder of said lever, supporting said stabilizing fixture by way of said operator's free hand holding said rod affixed to said stabilizing feature, said operator triggering said pneumatic hammer causing said pneumatic hammer to force said lever to rotate in an arcuate path which loosens or tightens said fastener.

* * * * *